United States Patent [19]

Johnson et al.

[11] 4,425,672

[45] Jan. 17, 1984

[54] SHOWER BATH UNITS

[76] Inventors: Raymond Johnson, 1218 Haywood Ave., West Vancouver, British Columbia, Canada, V7T 1V1; Ronald W. Kenny, 1510 955 Marine Dr., West Vancouver, British Columbia, Canada, V7T 1A9

[21] Appl. No.: 256,907

[22] Filed: Apr. 23, 1981

Related U.S. Application Data

[63] Continuation of Ser. No. 964,367, Dec. 20, 1978, abandoned.

[51] Int. Cl.[3] ..... A47K 3/22

[52] U.S. Cl. ..... 4/596; 4/604; 4/611; 4/612; 4/528

[58] Field of Search ..... 4/525, 598, 532, 611, 4/615, 661, 596, 597, 604, 605, 612, 613, 614, 567, 568, 569, 524, 528, 536

[56] References Cited

U.S. PATENT DOCUMENTS

| | | | |
|---|---|---|---|
| 1,978,623 | 10/1934 | Clifford | 236/93 B |
| 2,228,626 | 1/1941 | Hetherington | 236/93 B |
| 3,169,253 | 2/1965 | Segar | 4/611 |
| 3,396,411 | 8/1968 | Vieceli | 4/525 |
| 3,587,118 | 6/1971 | Compton | 4/598 |
| 3,690,555 | 9/1972 | Johnson | 137/468 X |
| 3,707,732 | 1/1973 | Cosper | 4/532 |
| 3,857,446 | 12/1974 | Kenny | 137/468 X |
| 3,962,733 | 6/1976 | Parry | 4/615 |
| 4,160,292 | 7/1979 | Kuether | 4/615 |

*Primary Examiner*—Henry K. Artis
*Attorney, Agent, or Firm*—Larson and Taylor

[57] ABSTRACT

A cabinet having a sealable door and in which a person sits with his neck extending through an opening in the cabinet top. A spray system in the cabinet is arranged to direct water over the body of the user, and pipe means connects the spray system to a source of temperature-controlled water. Control means is operable to cause this water to by-pass the spray system when the temperature thereof rises above or drops below a predetermined temperature range. Water is removed from the bottom of the cabinet through a drain hose.

15 Claims, 10 Drawing Figures

Figure 1:
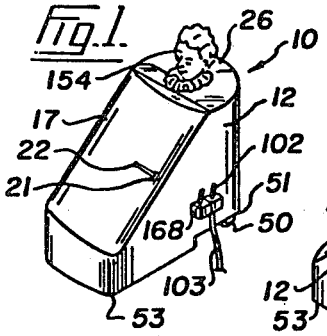

Fig. 5.
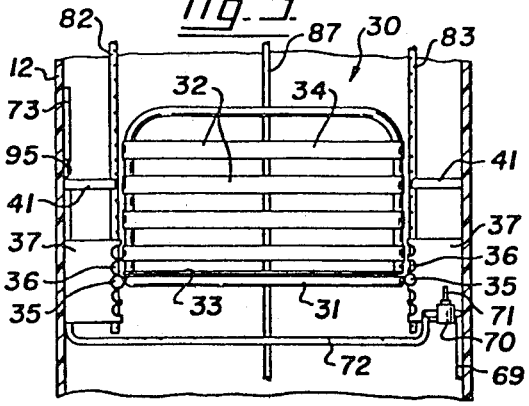
Fig. 6.
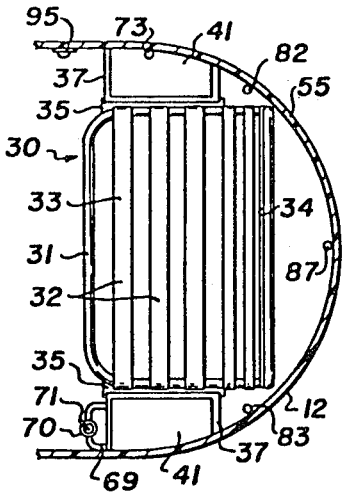
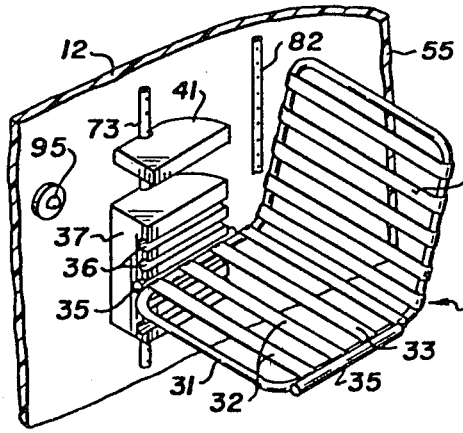
Fig. 7.
Fig. 8.
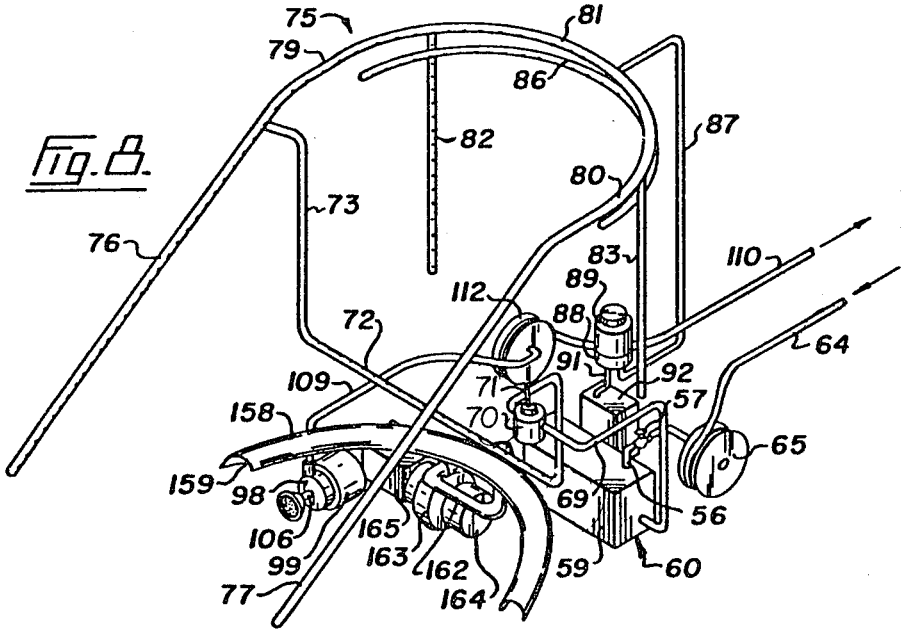

SHOWER BATH UNITS

This is a continuation of application Ser. No. 964,367 filed Dec. 20, 1978, now abandoned.

This invention relates to shower bath units in which people can sit and have complete shower baths.

It is often very difficult to bath elderly people, partially or completely disabled people, and people with some ailments. This operation is particularly difficult in homes where trained people are not available, and it is often difficult in hospitals, rest homes and the like even when trained people are available. In addition to this, there are many people living in their own homes who find it difficult to bath, and many have to have some assistance.

the present invention alleviates many of these problems by providing a spray bath unit having a cabinet in which a person can sit and completely bath himself. The user can completely control the operation, or he may have outside help. This shower bath unit can be portable in the same manner as the known portable dishwashing machines, or it may form part of a permanent installation.

Some attempts have been made in the past to fill this need, but they have not been very successful. Some units are constructed so that you cannot prevent water from being splashed outside them during use, most do not have any pump system for removal of water, thus necessitating a permanent connection to a drain system, most cannot be controlled from within the cabinet so that a person usually requires the assistance of a helper when taking a bath, and none of which the appliant is aware protects the user against variation in the temperature of the water during use.

The last-mentioned problem seems to be the main one that has kept the bathing units of the prior art off the market. This is particularly difficult for persons who have difficulty in moving or cannot move by themselves. The temperature of the water may be adjusted at the beginning, but the temperature of the hot water supply may drop either as the result of the supply running out, or of others turning the cold water taps and hot water taps on and off in the same water system. For example, of a person who requires assistance to move is left on his own in a bathing unit, a serious change in the water temperature can take place before the helper returns.

The present invention overcomes these disadvantages by providing a shower bath unit having a cabinet in which a person can sit with his neck extending through an opening in the top thereof. Individual towel neck gaskets are provided so that each one can have his own neck gasket or can be given a clean one. The neck gasket fits loosely around the person's neck and fits in a opening in the top of the cabinet so that water cannot splash out of the latter. Control means are provided inside and outside of the cabinet for starting and shutting off the water so that the user can turn the water on or off, or it can be turned on or off by an attendant. The water is directed over the user's body by a spray system. A soap spray system is provided in the cabinet to enable the user to spray soap solution over himself if desired. The water is collected in the bottom of the cabinet, and a motor-driven pump directs this water out through a drainage hose. Although the bath cabinet may be set up as a permanent installation, in the preferred form, it is a portable unit, and has a water hose with an end to be connected to a water tap, and a drainage hose with an end to be placed in a sink, laundry tub or a suitable sump for discharge. The discharge pump and electrical system is isolated from the interior of the cabinet where the user sits. If desired, a hot air system can be provided in the cabinet for drying purposes.

The temperature of the water being supplied to the spray system of the shower cabinet has to be adjusted at the source so that the water is temperature-controlled before it reaches the cabinet. However, with most water systems, and particularly domestic water systems, the temperature of the water emerging from the tap varies as the other taps in the system are turned on and off. In addition to this, if water is supplied to the bath cabinet for too long a time, it may run cold. The present shower cabinet contains a valve and temperature control arrangement so that if the temperature of the water being supplied to the cabinet rises above or falls below a predetermined temperature range, the water is by-passed directly to the water discharge system of the cabinet. Thus, there is no danger of the user being subjected to extremely hot or cold water. This is a very important feature since the people requiring shower cabinets are often people with disabilities or are often incapable of thinking or acting for themselves. The bather is automatically protected against high and low temperature water.

A shower bath unit in accordance with this invention comprises a cabinet having an entrance opening therein, a door for the opening, a clamping latch for the door, sealing means around the perimeter of the door to seal the entrance opening when the door is retained in the closed position by the clamping latch, a support in the cabinet for a user of the bath, a relatively small neck opening in the cabinet positioned so that the neck of the user positioned on the support can extend through said neck opening with the cabinet enclosing the body of the user from the neck down, spray means in the cabinet arranged to direct water from different directions over the body of the user, pipe means for connecting said spray means to a source of temperature-controlled water, control means connected to said pipe means to cause said water to by-pass the spray means when the temperature of the water rises above or drops below a predetermined temperature range, a control valve operable to start and stop said spray means, a sump in the bottom of the cabinet for receiving the water after it has been sprayed over the user, and means for removing water from the sump.

More specifically, a bath unit according to this invention comprises a cabinet having an entrance opening therein, a door for the opening, a clamping latch for the door, sealing means around the perimeter of the door to seal the entrance opening when the door is retained in the closed position by the clamping latch, a support in the cabinet for a user of the unit, a relatively small neck opening in the cabinet positioned so that the neck of the user positioned on the support can extend through said neck opening with the cabinet enclosing the body of the user from the next down, spray means in the cabinet arranged to direct water from different directions over the body user, a supply pipe having an end to be connected to a source of temperature-controlled water and an opposite end connected to said spray means, a motorized zone valve in said supply pipe, a by-pass pipe having one end connected to the supply pipe and an opposite discharge end, and an aquastat operatively connected to the supply pipe to be influenced by the temperature of the water passing therethrough and operatively connected to said zone valve to open the latter to valve to open the latter to direct water to the spray means when the temperature of said water is within a predetermined range and to close said valve to shut the water off from the spray means to allow the water to flow through the by-pass pipe when the temperature thereof is above or below said temperature range.

Figure 2:
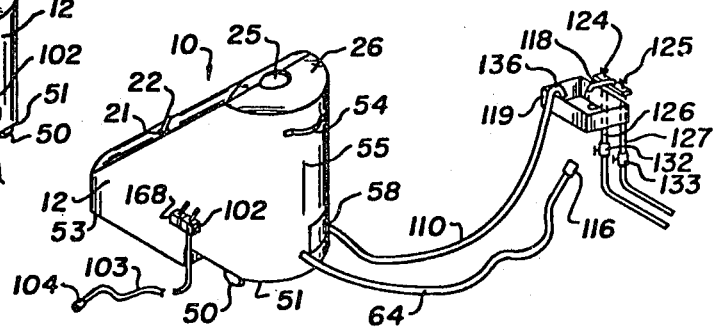
Figure 3:
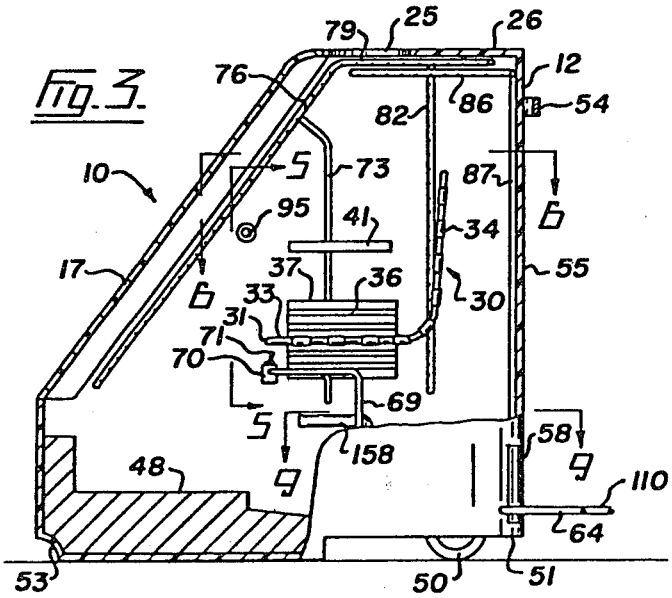
Figure 4:
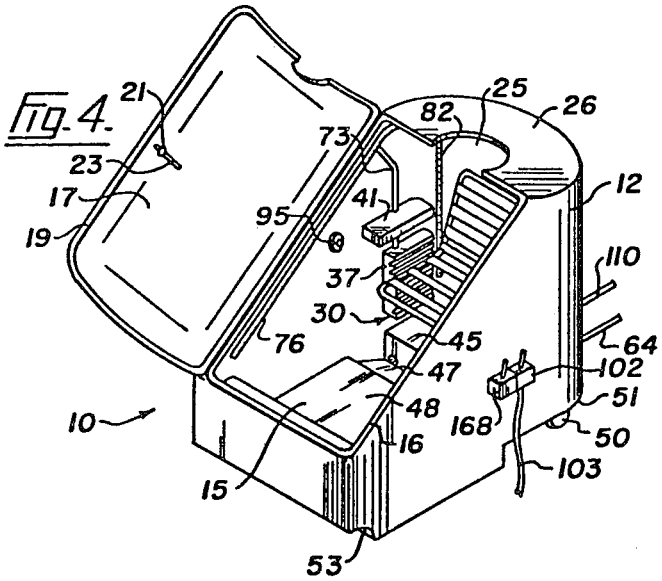
Figure 9:
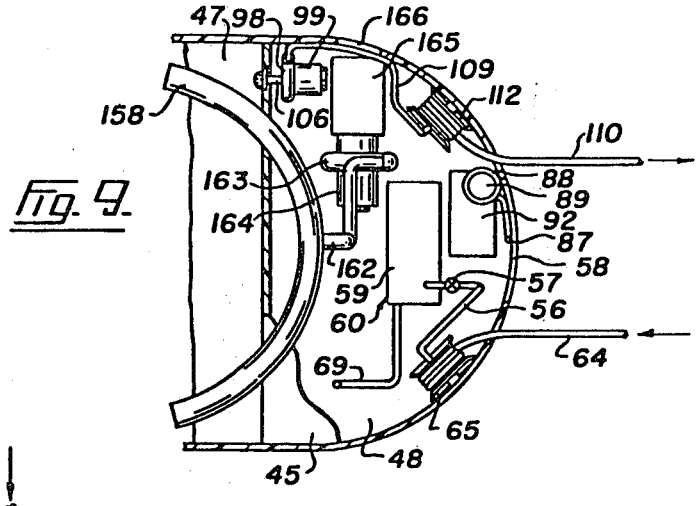
Figure 10:
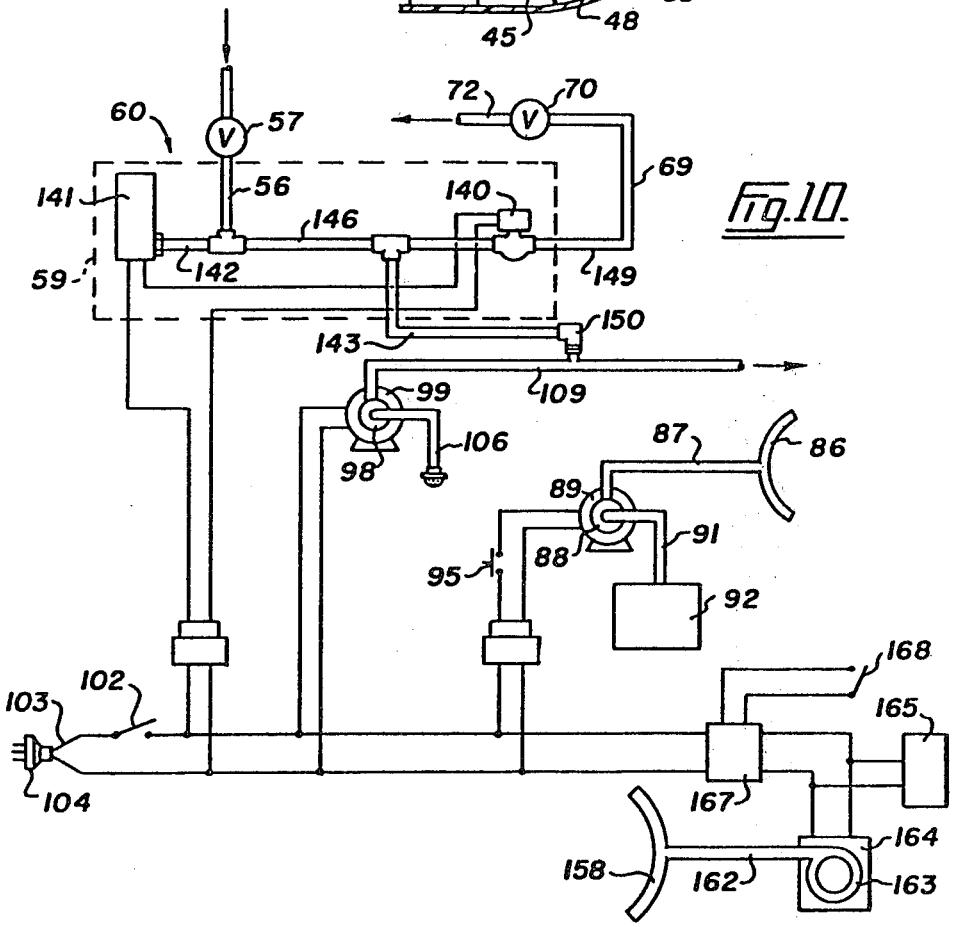

An example of this invention is illustrated in the accompanying drawings in which FIG. 1 is a diagrammatic perspective view of the shower bath unit looking at the front thereof, FIG. 2 is a similar perspective view looking at the back of the unit, FIG. 3 is a side elevation, partly broken away, of the unit, FIG. 4 is a perspective view of the unit with the door thereof open, FIG. 5 is an enlarged vertical sectional veiw taken on the line 5—5 of FIG. 3 and showing the seat of the unit in elevation, FIG. 6 is an enlarged sectional view taken on the line 6—6 of FIG. 3, FIG. 7 is a fragmentary perspective view showing the seat and the mounting for one side thereof, FIG. 8 is diagrammatic outline of the spraying, heating and soap applying systems of the shower unit, FIG. 9 is a horizontal section through the cabinet and taken on the line 9—9 of FIG. 3, FIG. 10 is a diagram of the water control, soap and heating systems of the shower unit.

Referring to the drawings, 10 is a shower bath unit in accordance with this invention, this unit including a cabinet 12 which is just large enough to house a person with his head projecting from the top thereof. Although the cabinet may be of such a size that a person using it would have to stand up, it is preferable to provide seat means within the cabinet so that the user can sit down with his head projecting above the top of the cabinet.

Cabinet 12 has a relatively large, substantially rectangular opening 15 in the front thereof with a sealing gasket 16 extending all the way around this opening. A door 17 is hingedly mounted on the cabinet and is of such size as to be able to completely close opening 15, said door having a matching gasket 19 around the edges thereof, which cooperates with gasket 16 to seal the cabinet closed when the door is shut. A latch 21 is provided for door 17, and has handles 22 and 23 respectively outside and inside the door so that the latter can be latched and unlatched from outside and inside the cabinet.

An opening 25 is formed in the top of 26 of cabinet 12 and opens out at the front edge of said top. This opening is substantially circular in shape, and one side thereof is closed by door 17 when the latter is shut. A seat 30 of any desired construction is mounted in cabinet 12 for vertical adjustment. In this illustrated example, the seat has a tubular frame 31 with spaced-apart strips 32 formed of plastic or other suitable material stretched thereacross, said frame being bent to form a seat portion 33 and a back portion 34, see FIGS. 5, 6 and 7. Tubes 35 are secured to extend along the frame 31 at the sides of seat portion 33, and are adapted slidably to fit into opposed pairs of horizontal and vertically spaced slots 36 formed in supports or blocks 37 mounted on the inner surfaces of the side walls of cabinet 12. The height of the seat above the cabinet floor can be adjusted by slipping the tubes 35 of the seat frame into different pairs of slots 36 in supports 37. An arm rest 41 is mounted on each cabinet side wall above the level of seat portion 33.

A compartment 45 is positioned within cabinet 12 below the level of seat 30 and is completely isolated from the interior of the cabinet by suitable insulating and sealing means, not shown. A sump 47 is formed in the floor 48 of the cabinet. Cabinet 12 is provided with wheels 50 at the bottom thereof near its rear wall, one wheel at each side of the cabinet. There wheels are preferably countersunk into the sides of the cabinet, as shown at 51 in FIG. 1, and are low enough to just clear the bottom of the cabinet of the floor. The front edge 53 of the cabinet bottom rests on the floor. A handle 54 is provided on the back wall 55 of the cabinet near the top thereof.

Spraying means, hereinafter described, is provided within cabinet 12 and is such as to be able to spray temperature-controlled water over the entire body of a person resting on seat 30.

A water inlet pipe 56 is located in compartment 45 and has a control cock 57 therein adjacent on access door 58 in the cabinet back wall 55 near the bottom thereof. Pipe 56 has an end extending into a casing 59 mounted within the compartment and housing the temperature control apparatus 60 illustrated in FIG. 10 and hereinafter described. The opposite end of pipe 56 is connected either directly to an end of a water supply hose 64 which extends out of the cabinet, or to said hose end through a spring-load reel 65 around which the hose extends before leaving the cabinet. As storage reels of this type are well known and are available on the market, it is not necessary to describe the reel herein in detail.

A pipe 69 extends outwardly from casing 59 and compartment 45 near one side of cabinet 12 near the bottom thereof and extends upwardly to a shut-off valve 70 mounted within the cabinet and having an operating handle 71, see FIGS. 3 and 8. This operating lever is near an end of an arm rest 41 so that it can be grasped by a person on seat 30. A transverse section of pipe 72 extends from valve 70 across the cabinet below the level of seat 30, and has a plurality of fine holes therein to act as nozzles for spraying water both forwardly and upwardly within the cabinet. The opposite end of spray pipe 72 is connected to an unperforated pipe 73 which extends upwardly to a perforated spray pipe system 75. This system includes a plurality of pipe sections within cabinet 12 positioned to direct water over the front, sides, and back of the person resting on seat 30. For example, system 75 can include vertically inclined pipe sections 76 and 77 located inside the cabinet at opposite sides of door opening 15, as shown in FIGS. 3 and 8. The perforations of these sections spray water back towards the person on seat 30. Horizontal sections 79 and 80 connect the upper ends of pipe sections 76 and 77 to a transverse pipe section 81. The pipe sections 79, 80 and 81 are located near the top of the cabinet and spray water downwardly and inwardly onto the sides and back of the user. Vertical spray pipe sections 82 and 83 may extend down from pipe section 81 in the back corners of the cabinet. Different other perforated spray pipe sections may be used as desired within the cabinet.

A suitable soap system may also be provided. In this example, a perforated pipe 86 is mounted in and extends across the back of the cabinet and near pipe section 81. This pipe 86 is preferably curved so that it extends across one shoulder of the person on the seat, across the back of this person just below the neck level, and across his opposite shoulder. A pipe 87 extends downwardly from pipe 86 and into compartment 45 to the outlet of a pump 88 driven by an electric motor 89, see FIGS. 8, 9 and 10. A hose 91 extends from the inlet of said pump into a soap solution reservoir 92 mounted in compartment 45. Motor 89 is controlled by a switch 95 mounted on a side wall of cabinet 12 adjacent one end of one of the arm rests 41, see FIG. 7. Reservoir 92 can be removed for filling through door 58 of compartment 45.

The waste flows into sump 47 at the bottom of the cabinet, from which it is drawn by a pump 98 driven by a motor 99, both of these units being located within compartment 45. An electric switch 102 is mounted on the outside of cabinet 12 from which extends an electric cord 103 having a connection plug 104 on its outer end. This switch controls motor 99, see FIG. 10. A pipe 106 extends from the inlet of pump the and opens out from compartment 45 into sump 47 at the bottom thereof. The outlet of pump 98 has a pipe 109 connected thereto, the opposite end of this pipe being connected either directly to a drain hose 110 extending out of the cabinet or, as shown, connected to said hose through a spring-load reel 112 around which hose 110 is wound. This reel is rotatably mounted in compartment 45, and is similar to reel 65.

If bath unit 10 is a permanent installation, the water inlet pipe or hose 64 is permanently connected to a source of temperature-controlled water, and drain pipe 110 is permanently connected to a drain system. However, unit 10 is preferably portable, in which case 64 is a hose adapted to be connect to a tap and 110 is a hose adapted to discharge into a sump, basin, sink of the like.

In this example, hose 64 has a fitting or adapter 116 of the type to be pressed over the outlet spout 118 of a domestic water system, the illustrated spout being located over a sink or basin 119. This portion of the domestic water system is in general use, and has taps 124 and 125 which are connected respectively to hot water and cold water pipes of the domestic system. Pipes 126 and 127 usually have shut-off valves 132 and 133, respectively, therein, and located below the sink.

Drain hose 110 has its free end 136 shaped to be hooked over the edge of sink 119 to discharge therein.

The temperature control apparatus 60 mounted in casing 59 includes a motorized valve 140, a standard aquastat 141 and a by-pass pipe 143. Inlet pipe 56 is connected by a pipe 146 to an inlet of valve 140. The sensor of aquastat 141 is in contact with the water flowing from pipe 56 to pipe 142. By-pass pipe 143 extends from pipe 146 to the sump 47 or, as shown, to drain pipe 109, and another pipe 149 connects the outlet of the valve to pipe 69 of the spray system of the cabinet. Pipe 143 has an adjustable needle valve 150 therein.

Valve 140 is well-known in the market and is generally called a zone valve. Aquastat 141 is electrically connected to the motor of the zone valve. Water from pipes 56 and 146 normally travels through valve 140 and through pipe 149 to pipe 69. Aquastat 141 is set so that when the temperature of the water entering the system through pipe 56 goes above or below a predetermined range, valve 140 is closed to prevent the water from reaching the spray system, at which time all of the water is directed to the sump of the bath unit or to drain pipe 109. In other words, only water within the predetermined temperature range reaches the spray system of the cabinet through pipe 69. The temperature range for normal bathing is something of the order of 92° F. to 108° F.

The apparatus also includes one or more neck gaskets 154 formed of heavy towelling material or the like. Each person may have his own neck gasket, or a number may be provided so that each user can have a clean one. This neck gasket or towel is of tubular formation and is sized to stretch sufficiently to fit over the head of a person and then to contract to fit loosely around his neck. When the person is seated in the bath unit, the towel or gasket fits loosely in the opening 25 in the top of the cabinet to prevent water from splashing out of the latter.

If desired, a warm air drying system may be provided in cabinet 12. In this example, a curved heater pipe 158 is mounted in the cabinet spaced from the bottom thereof, said pipe having a slot 159 therein and facing downwardly and extending throughout part or all of the length of the pipe. This pipe extends across the back of the cabinet and along its two sides. A supply pipe 162 is connected to pipe 158 and extends into compartment 45 to the outlet of a fan blower 163 driven by a motor 164. An electric heater 165 is mounted in compartment 45 and located so as to heat air drawn into blower 163. A vent 166 is provided for this compartment through which air is drawn by the blower. A transformer and relay unit 167 is in an electrical system with and controls the supply of current to motor 164 and heater 165. This unit is controlled by a switch 168 located on the outer surface of the unit near switch 102, and connected to the power source cord 103. When in operation, blower 163 draws air through heater 165 and directs the warm air into cabinet 12 for drying purposes. If desired switch 168 may be mounted inside the cabinet, or another switch is parallel with switch 168 may be mounted in the cabinet so the drying system can be turned on and off from outside and from inside the cabinet.

An example of a satisfactory electrical system for unit 10 is shown in FIG. 10.

The shower bath unit is quite easy to use, and may be operated completely by the person wishing to take a bath, or the person may be assisted into the unit by an attendant, and the latter control the operation.

In either case, the water of the domestic system is turned on, and the temperature of the water emerging from spout 118 is adjusted by means of valves 132 and 133. These valves may, if desired, by left at the desired setting. Then taps 124 and 125 are turned off to enable the adapter 116 to be forced onto the end of spout 118. The end 136 of drain hose 110 is positioned to discharge into sink 119, and the plug 104 is inserted into an electrical outlet. If the flow of water is to be controlled by the person inside the cabinet 12, cock 57 is left open, and the flow is controlled by means of valve 70 within the cabinet. On the other hand, if the water flow is to be controlled by an attendant outside the cabinet, valve 70 is left open, and the flow is controlled by cock 57.

A gasket 154 is placed around the neck of the user, seat 30 is adjusted to the desired height in the cabinet, and then the person backs into the cabinet and sits on the seat with his neck extending through opening 25. After door 17 has been closed, it is secured by latch 21 either by means of outer handle 22 or inner handle 23. Taps 124 and 125 are then turned full on, and the sump pump 98 is set into operation by the operation of switch 102. This also connected aquastat 141 and valve 140 to the source of electrical power. If the user is operating the apparatus of his own, he would turn switch 102 on before getting into the cabinet.

When cock 57 is open, the temperature-controlled water is directed to the temperature-control apparatus 60, so that if the water temperature is above or below the desired predetermined range, the water is directed through by-pass pipe 143 to sump 47 or to drain pipe 109 of the apparatus. As soon as the temperature of the water reaches the desired level, zone valve 140 is opened to allow water to flow through pipes 149 and 69 to the spray system of the cabinet. When valve 70 is opened, the water is directed through the spray pipe system over the entire body of the person on seat 30. When that person requires soap, switch 95 is operated to cause soap solution to be pumped from container 92 through spray pipe 87 to spray pipe 86. Following this the spraying of the water is allowed to continue until the person is completely rinsed off. Then the flow of water is stopped either by valve 70 or cock 57. If the bather wishes to be dried by warm air, switch 168 is operated to cause blower 163 to direct warm air into the cabinet through pipes 162 and 158. As this air is directed downwardly by pipe 158, it is spread across the entire cabinet by the cabinet floor, and then flows upwardly around the person on the seat. After the bather has left the cabinet, taps 124 and 125 are turned off, switches 102 and 168 are turned off, the hoses 64 and 110 removed from the sink. The unit 10 can be rolled away on its wheels 50 for storage.

The embodiments of the invention in which an exclusive property or privilege is claimed are defined as follows:

1. A shower bath unit comprising a cabinet having an entrance opening therein, a door for the opening, a clamping latch for the door, sealing means around the perimeter of the door to seal the entrance opening when the door is retained in the closed position by the clamping latch, a support in the cabinet for a user of the unit, a relatively small neck opening in the cabinet positioned so that the neck of the user positioned on the support can extend through said neck opening with the cabinet enclosing the body of the user from the neck down, spray means in the cabinet arranged to direct water from different directions over the body of the user, a supply pipe having an end to be connected to a source of temperature-controlled water and an opposite end connected to said spray means, a zone value in said supply pipe, a by-pass pipe having one end connected to the supply pipe and an opposite discharge end, and aquastat operatively connected to the supply pipe to be influenced by water passing therethrough and operatively connected to said zone valve to cause the latter to direct water to the spray means when the temperature of said water is within a predetermined range and to shut off the flow of water to the spray means when the temperature thereof is above a first predetermined upper temperature or below a second, substantially lower predetermined temperature of said temperature range, at which time the water flows through the by-pass pipe, whereby a user is automatically protected from being sprayed with water that is too hot too cold relative to an acceptable bathing range, a control valve operable to start and stop said spray means for removing water from the cabinet after said water has been sprayed over the user.

2. A shower bath unit as claimed in claim 1 in which said water removing means comprises a sump in the bottom of the cabinet for receiving said sprayed water.

3. A shower bath unit as claimed in claim 1 comprising a replacable neck towel for said neck opening adapted to fit loosely around the user's neck.

4. A shower bath unit as claimed in claim 1 comprising an inner handle connected to said clamping latch inside the cabinet, and an outer handle connected to said latch outside the cabinet, whereby the clamping latch can be operated from inside and from outside the cabinet.

5. A shower bath unit as claimed in claim 1 in which said control valve is located within the cabinet and positioned to be reached by the user, and including a second control valve operable from outside the cabinet to start and stop said spray means.

6. A shower bath unit as claimed in claim 1 comprising second spray means in the cabinet arranged to direct a soap solution over portions of the user's body, and control means in the cabinet operable by the user to cause said second spray means to eject soap solution.

7. A shower bath unit as claimed in claim 1 in which said control means comprises a control valve in said pipe means and operated by an aquastat.

8. A shower bath unit as claimed in claim 1 in which said pipe means comprises a hose connected at one end of the spray means, and an adapter connected to the opposite end of the hose for connecting the latter to a domestic water system, and said water removing means comprises a motor driven pump in the cabinet and having an inlet connected to a sump in the bottom of the cabinet and an outlet connected to one end of a hose extending away from the cabinet and having an opposite end free to discharge into a drain of a domestic drain system.

9. A shower bath unit as claimed in claim 1 in which said support comprises a seat, and including means for adjustably mounting the seat at different levels in the cabinet.

10. A shower bath unit as claimed in claim 1 comprising means in the cabinet arranged to direct a soap solution over portions of the user's body, a reservoir for soap solutions, pump means connected to the reservoir and the second spray means operable to direct soap solution to said second spray means, and switch means operable to start and stop the pump means.

11. A shower bath unit as claimed in claim 1 comprising a warm air system operable to direct warm air into the cabinet.

12. A shower bath unit comprising a cabinet having an entrance opening therein, a door for the opening, a latch for the door, a support in the cabinet for a user of the unit, a relatively small neck opening in the cabinet positioned so that the neck of the user positioned on the support can extend through said neck opening with the cabinet enclosing the body of the user from the neck down, spray means in the cabinet arranged to direct water from different directions over the body of the user, pipe means for connecting said spray means to a source of temperature-controlled water, control means connected to said pipe means automatically operable instantly to cause said water to by-pass the spray means when the temperature of the water rises above a first predetermined upper temperature or drops below a second substantially lower predetermined temperature of a predetermined temperature range whereby a user is automatically protected from being sprayed with water that is either too hot or too cold relative to an acceptable bathing range, a control valve at the cabinet operable to start and stop said spray means, and means at the cabinet for removing water from the cabinet after said water has been sprayed over the user.

13. A shower bath unit as claimed in claim 12 in which said latch is a clamping latch, and said unit comprises sealing means around the perimeter of the door to seal the entrance opening when the door is retained in the closed position by said clamping latch.

14. A shower bath unit comprising a portable cabinet having an entrance therein, a door for the opening, a clamping latch for the door, sealing means around the perimeter of the door to seal the entrance opening when the door is retained in the closed position by the clamping latch, a support in the cabinet for a user of the unit, a relatively small neck opening in the cabinet positioned so that the neck of the user positioned on the support can extend through said neck opening with the cabinet enclosing the body of the user from the neck down, spray means in the cabinet arranged to direct water from different directions over the body of the user, an inner operating handle connected to said clamping latch inside the cabinet, an outer operating handle connected to said latch outside the cabinet, pipe means for connecting said spray means to a source of temperature-controlled water, control means connected to said pipe means automatically to cause said water to by-pass the spray means when the temperature of the water rises above a first predetermined upper temperature or drops below a second, substantially lower predetermined temperature of a predetermined temperature range whereby a user is automatically protected from being sprayed with water that is either too hot or too cold relative to an acceptable bathing range, a drain pipe for removing water from the cabinet, pump means in the cabinet for directing to said drain pipe water that has been sprayed over the user and water that has by-passed the spray means, and valve means in said pipe means inside and outside the cabinet operable to permit the flow of the temperature-controlled water to the spray means and to stop said flow.

15. A shower bath unit as claimed in claim 12 in which said pipe means comprises piping continuously directing the water coming from the source to said water removing means, and said control means is adapted to direct water from said piping to the spray means only when the temperature of said water is within said predetermined temperature range.

* * * * *